US008869813B2

(12) United States Patent
Kanayama

(10) Patent No.: US 8,869,813 B2
(45) Date of Patent: Oct. 28, 2014

(54) REINFORCING TAPE, CLOTH PRODUCED BY SEWING SAID REINFORCING TAPE, AND WEB STRUCTURE UTILIZING SAID REINFORCING TAPE

(75) Inventor: Yotaro Kanayama, Kobe (JP)

(73) Assignee: finetrack, Kobe-shi (JP)

( * ) Notice: Subject to any disclaimer, the term of this patent is extended or adjusted under 35 U.S.C. 154(b) by 0 days.

(21) Appl. No.: 13/147,652

(22) PCT Filed: Jan. 20, 2010

(86) PCT No.: PCT/JP2010/050632

§ 371 (c)(1),
(2), (4) Date: Sep. 6, 2011

(87) PCT Pub. No.: WO2010/090073

PCT Pub. Date: Aug. 12, 2010

(65) Prior Publication Data

US 2011/0315180 A1 Dec. 29, 2011

(30) Foreign Application Priority Data

Feb. 6, 2009 (JP) ..... 2009-026284
Jan. 18, 2010 (JP) ..... 2010-008351

(51) Int. Cl.

| | |
|---|---|
| ***E04H 15/00*** | (2006.01) |
| ***E04H 15/02*** | (2006.01) |
| ***E04H 15/32*** | (2006.01) |
| ***D03D 3/00*** | (2006.01) |
| ***D03D 15/00*** | (2006.01) |
| ***D03D 1/00*** | (2006.01) |

(52) U.S. Cl.

CPC ..... *D03D 15/00* (2013.01); *D03D 15/0077* (2013.01); *D10B 2321/021* (2013.01); *D10B 2331/02* (2013.01); *D10B 2201/02* (2013.01); *D10B 2505/18* (2013.01); *D10B 2401/063* (2013.01); *E04H 15/00* (2013.01); *D10B 2331/021* (2013.01); *D10B 2403/0311* (2013.01); *D10B 2101/12* (2013.01); *D03D 1/00* (2013.01); *D03D 3/005* (2013.01); *D03D 15/0027* (2013.01); *D10B 2505/02* (2013.01)

USPC ..... 135/90; 135/115; 135/119; 135/120.1; 139/426 R; 442/203; 442/301; 428/102; 52/3; 52/5

(58) Field of Classification Search

CPC ... D03D 1/0005; D03D 1/0094; D03D 1/008; D03D 1/06; D03D 3/00; D03D 3/005; E04H 15/425; E04H 15/00; E04H 15/02; E04H 15/06; E04H 15/08; E04H 15/32

USPC ..... 428/102, 223; 442/203, 301, 239, 243; 139/426 R; 135/90, 115, 119, 120.1, 135/120.2, 120.3; 52/3, 5

See application file for complete search history.

(56) References Cited

U.S. PATENT DOCUMENTS 3,669,158 A 6/1972 Phillips
3,756,288 A * 9/1973 Seo et al. ..... 139/383 R (Continued)

FOREIGN PATENT DOCUMENTS

CN 1172508 A 2/1998
CN 2730781 Y 10/2005

(Continued)

OTHER PUBLICATIONS

Thread Definition Merriam-Webster Dictionary, published 2013.*

(Continued)

*Primary Examiner* — Aaron Austin
*Assistant Examiner* — Joanna Pleszczynska
(74) *Attorney, Agent, or Firm* — Knobbe Martens Olson & Bear LLP

(57) ABSTRACT

Provided are a lightweight, compact reinforcing tape capable of improving a tensile strength. A reinforcing tape for reinforcing a tensile strength of a cloth includes weft threads which constitute a weave structure of the reinforcing tape, and warp threads which constitute a weave structure of the reinforcing tape, wherein a part of the warp threads are made of a high-strength fiber.

27 Claims, 6 Drawing Sheets

(56) References Cited

U.S. PATENT DOCUMENTS

| | | | | |
|---|---|---|---|---|
| 4,405,669 | A | 9/1983 | Pott | |
| 5,482,763 | A | 1/1996 | Shaffer | |
| 5,935,881 | A * | 8/1999 | Abiru et al. | 442/97 |
| 6,220,264 | B1 * | 4/2001 | Newman | 135/90 |
| 6,470,901 | B1 * | 10/2002 | Scherer | 135/136 |
| 2004/0154684 | A1 * | 8/2004 | Baudonnel | 139/426 R |
| 2004/0226224 | A1 * | 11/2004 | Scherer | 52/3 |
| 2005/0211082 | A1 * | 9/2005 | Angeloni et al. | 87/3 |

FOREIGN PATENT DOCUMENTS

| | | | |
|---|---|---|---|
| CN | 2751052 | Y | 1/2006 |
| JP | 07-238266 | A | 9/1995 |
| JP | 8260715 | A | 10/1996 |
| JP | 2008057221 | A | 3/2008 |
| JP | 2008057273 | A | 3/2008 |

OTHER PUBLICATIONS

Partial translation of Introduction page of zelt in home page of Finetrack Co., Ltd.; http://www.finetrack.com/product/detail_FAG0102.html; Jan. 23, 2009.

International Search Report; PCT/JP2010/050632.

Extended European Search Report issued Jun. 25, 2013 in corresponding EP Application No. 10738411.7.

Office Action dated Jun. 3, 2013 in corresponding China Patent Application No. 201080006874.8.

Office Action dated Dec. 26, 2012 in corresponding China Patent Application No. 201080006874.8.

Office Action issued Aug. 30, 2013 in corresponding Chinese Patent Application No. 201080006874.8.

Office Action mailed Aug. 18, 2014 in corresponding KR patent application No. 10-2011-7019653.

* cited by examiner (a)

(b)

(c)

REINFORCING TAPE, CLOTH PRODUCED BY SEWING SAID REINFORCING TAPE, AND WEB STRUCTURE UTILIZING SAID REINFORCING TAPE

CROSS-REFERENCE TO RELATED APPLICATIONS

This application is the U.S. National Phase under 35. U.S.C. §371 of International Application PCT/JP2010/050632, filed Jan. 20, 2010, which claims priority to Japanese Patent Application No. 2009-026284, filed Feb. 6, 2009, and Japanese Patent Application No. 2010-008351, filed Jan. 18, 2010. The International Application was published under PCT Article 21(2) in a language other than English.

TECHNICAL FIELD

The present invention relates to a reinforcing tape for reinforcing the tensile strength of a cloth, a cloth produced by sewing the reinforcing tape, a zelt, a tarp or a tent using the cloth, and a web structure constituted using the reinforcing tape. More particularly, the present invention relates to a lightweight, compact reinforcing tape capable of suppressing elongation of a sewn part and significantly improving a tensile strength of a zelt, a tent, a tarp, or the like.

BACKGROUND ART

Tents, zelts, tarps, hammocks, and the like, which are used outdoors, are made by sewing, for example, a nylon or polyester cloth, and the tensile strengths of a zenith part and a ridge line part running to corners (bottoms) mainly rely on the strength of the cloth (see Non-patent Document 1). Such tents, zelts or tarps are required to be lightweight and compact, and to have durability in environments in which they are used, such as light resistance and water resistance, due to the situations in which they are used. When the tents, zelts and tarps are used, tension must be applied to predetermined areas of the cloth so as to form a roof part and wall parts, and therefore a predetermined tensile strength is required for the cloth (see Patent Document 1 as an example of a trap).

It is difficult, however, to satisfy all of the requirements for the cloth for these tents, zelts or tarps. In other words, if a weight per unit length of the cloth is increased, a tensile strength can be improved, but the cloth is heavy and bulky, and thus the requirements of lightness in weight and compactness cannot be satisfied. On the other hand, if a weight per unit length of the cloth is decreased in order to satisfy the requirements of lightness in weight and compactness, a tensile strength is reduced, and thus the cloth cannot withstand the applications.

For that reason, parts to which tension is applied are stitched with a different tape cloth and doubled, so as to be lightweight and compact, and have a tensile strength satisfied to some extent. Although tapes made of a nylon or polyester cloth have hitherto been used as the different tape, both of them have a large elongation and an insufficient tensile strength, and, problematically, become heavy and bulky if it is intended to ensure the tensile strength. In addition, when the nylon tape is used, a water-repellent treatment is required, because the tape is elongated and the strength is markedly reduced after being wet. Even when parts to which tension is applied are constituted by putting a margin to seam of a cloth on another margin to seam and sewing these margins with stitching, the tensile strength of the cloth itself is not increased, which is insufficient. Also, a conventional tape cloth is sandwiched between margins to seam (overlapped seam, rolled seam, or the like) of cloth, and is sewn with stitching, but, in this case, if the lightness in weight is satisfied, then the tensile strength is insufficient. In addition, the conventional tape cloths are plain weave tapes having dense lattices and no stretch stiffness. If they are sewn with stitching, puckering (shrinkage by sewing) occurs, which is a cause of quality degradation. Therefore, improvements are required.

In the zelt shown in Non-patent Document 1, a rope made of a high-strength polyethylene (a trade name "Dyneema (registered trademark)") is inserted into several guides placed on parts to which tension is applied of a backing cloth, and is threaded into the backing cloth. In such a case, though the tensile strength in the direction of tension is high, the tensile strength in a direction perpendicular to the direction of tension relies on the strength of the cloth itself because the rope is not sewn throughout the cloth, which lacks balance. Therefore, improvements are required. As the sewing of guides and rope-sewing are highly difficult and thus the working is carefully performed in order to maintain product quality; as a result, it is necessary to improve the production cost as well.

PRIOR ART DOCUMENTS

Patent Document

Patent Document 1: JP-A-2008-57273

Non-patent Document

Non-Patent Document 1: introduction pages of zelt in home page of Finetrack Co., Ltd., [online], [searched on Jan. 23, 2009], Internet <URL: http://www.finetrack.com/product/detail_FAG0102.html>

SUMMARY OF THE INVENTION

Problems to be Solved by the Invention

In view of the problems described above, the present invention has been made, and aims at providing a lightweight, compact reinforcing tape capable of improving a tensile strength, a cloth produced by sewing the reinforcing tape, a tent, a zelt and a tarp using the cloth, and a web structure constituted using the reinforcing tape.

Means for Solving the Problem

The invention is directed to a reinforcing tape for reinforcing a tensile strength of a cloth includes:

weft threads which constitute a weave structure of the reinforcing tape, and warp threads which constitute a weave structure of the reinforcing tape, wherein a part of the warp threads are made of a high-strength fiber.

According to such a structure, a tensile strength in the warp thread direction (the longitudinal direction of the tape) can be significantly improved because the high-strength fiber is used as a part of the warp threads in the reinforcing tape.

Also, a part of the weft threads constituting the weave structure of the reinforcing tape can be made of the high-strength fiber. According to such a structure, because the high-strength fiber is used as a part of the weft threads of the reinforcing tape, a tensile strength in the part (the width direction of the tape) can be significantly improved. For example, when the part made of the weft threads of the high-strength fiber is sewn to a cloth, a tensile strength in the weft thread direction can be significantly improved and thus breaking or tearing of the cloth caused by tension can be effectively suppressed.

The high-strength fiber as a part of the warp threads can be placed at any position of the multiple warp threads, and a structure in which the part made of the high-strength fiber and a part made of other warp thread fiber are alternately placed is also possible. This high-strength fiber may be either a monofilament or a multifilament. The multifilament is preferable in terms of the flexibility. The high-strength fiber may be made into a composite textured yarn with various materials such as cotton, Es and nylon.

The high-strength fiber, which constitutes a part of the weft threads, may be partially woven into the reinforcing tape and may be distributed into multiple sections. This high-strength fiber may be either a monofilament or a multifilament. The multifilament is preferable in terms of the flexibility. The high-strength fiber may be made into a composite textured yarn with various materials such as cotton, Es and nylon. In usual, the end of the weft thread may be connected to the end of the high-strength fiber by means of bonding in which the thread end is tied to the fiber end, heat adhesion, melt adhesion, adhesive-bonding, or a bonding in which the thread and the fiber are twined to each other.

The high-strength fiber is preferably made of a fiber which is lightweight and is not bulky, and has a high tensile strength. With respect to the lightness in weight of the high-strength fiber, a specific gravity is preferably 1.8 or less, more preferably 0.99 or less, furthermore preferably 0.97 or less. The high-strength fiber has a density of 1.8 g/cm$^3$ or less, more preferably 0.99 g/cm$^3$ or less, further more preferably 0.97 g/cm$^3$ or less. The high-strength fiber preferably has a tensile strength of 20 cN/dtex or more, more preferably 26 cN/dtex or more. The high-strength fiber preferably has a modulus of elasticity of 400 cN/dtex or more, more preferably 750 cN/dtex or more. With respect to the physical properties of the fiber, using a "Tensilon" manufactured by Orientec Co., Ltd., under conditions of a sample length of 200 mm and an elongation rate of 50%/minute, a stress-strain curve is measured at an ambient temperature of 20° C. under a relative humidity of 65%, and the tensile strength (cN/dtex) and an elongation at break (%) are obtained by calculation from a stress and an elongation at a breaking point. Also the modulus of elasticity (cN/dtex) is obtained by calculation from a tangential line giving a maximum incline around the origin of the curve. The mean of 10 measurements is used as each value. When fineness is measured, an about two-meter single yarn is taken out, one meter thereof is weighed, and the obtained weight is converted into 10000 m weight, which is expressed as the fineness (dtex). The high-strength fiber has, preferably, an excellent wear resistance, an excellent resistance to fatigue from flexing and an excellent light resistance, in view of the outdoor environment in which it is used and the portability for emergency use.

Examples of the high-strength fiber may include polyethylene fibers, aramid fibers, carbon fibers, polyacrylate fibers, and poly-p-phenylene benzobisoxazole (PBO) fibers. Examples of the polyethylene fiber may include Dyneema (registered trademark) SK 60 or SK 71, which is an ultrahigh molecular weight polyethylene fiber. The aramid fiber is made of an aromatic polyamide having a linear molecular structure, and may include, for example, Kevlar (registered trademark) and Nomex (registered trademark). The carbon fiber is a fiber produced by carbonizing an acrylic fiber or pitch (a by-product in production of petroleum, coal or coal tar) as a raw material at a high temperature, and may include, for example, Torayca (registered trademark). Examples of the polyacrylate fiber may include Vectran (registered trademark). Examples of the PBO fiber may include Zylon (registered trademark). The high-strength fiber, which is used as a part of the warp threads, can be made of a single fiber or a combination of multiple fibers selected from the group consisting of the above-mentioned polyethylene fibers, aramid fibers, carbon fibers, polyacrylate fibers and PBO fibers.

A weaving method is not particularly limited, and a plain weave, a diagonal weave and a herringbone weave may be exemplified, in terms of the strength.

The weft thread and the warp thread, which constitute the weave structure of the reinforcing tape, are not particularly limited, and examples thereof may include polyamide fibers (such as nylon), polyester fibers (such as ester fibers), rayon fibers, polyester fibers, and polyacrylonitrile fibers. The weft thread and the warp thread may be a monofilament or a multifilament. Also, each of the weft thread and the warp thread may be made of different kinds of fibers or the same kind of fiber.

In the present invention, the weft thread and the warp thread are preferably a monofilament made of any fiber material selected from the group consisting of rayon fibers, polyamide fibers, polyester fibers and acrylic fibers. A reinforcing tape having a plain weave structure of monofilament weft threads and warp threads has body and is lightweight and compact, and puckering can be prevented when the tape is sewn to a cloth. The polyester monofilament is particularly preferable as the weft thread and the warp thread, in terms of the lightness in weight, the compactness, the high durability, the low water absorbability and the low elongation. The monofilament preferably has a loop strength, measured in accordance with JIS L 1013, of 3.0 cN/dtex or more, more preferably 5.0 cN/dtex or more, and preferably has a tensile strength, measured in accordance with JIS L 1013, of 1.5 cN/dtex or more, more preferably 2.0 cN/dtex or more. The monofilament preferably has a diameter or a section size of 0.05 mm to 1.0 mm, more preferably 0.05 mm to 0.15 mm, in terms of the lightness in weight, the compactness and the strength. The cross-sectional shape thereof is not particularly limited, and is preferably a round shape.

In the present invention, coarse lattices (holes) are provided on the plain weave structure, and the high-strength fiber is placed at the center section toward the width direction of the reinforcing tape. Such a structure can make the reinforcing tape be appropriately sewn (for example, sewing with stitching) to a cloth using the lattices at the ends in the width direction, while the high-strength fiber does not interfere with the sewing. In a case where the high-strength fiber has a low frictional property, the high-strength fiber is placed for weaving at the center section in the width direction of the reinforcing tape, as described above, and thus weaving can be easily performed. The coarse lattices of the plain weave structure preferably have an aperture of 0.1 mm or more and 2 mm or less, more preferably 0.1 mm or more and 1 mm or less, in terms of the strength, the lightness in weight, and the easiness of sewing with stitching.

Another aspect of the present invention is a cloth produced by sewing the reinforcing tape, as described above. The cloth is not particularly limited, and may be made of a polyester fiber, a nylon fiber, a rayon fiber or a composite textured fiber thereof. When the cloth is used as a zelt for emergency, and the like, the lightness in weight and the compactness are particularly required, and thus a nylon fiber is preferable. A sewn site in which the reinforcing tape is sewn to the cloth is not particularly limited, and the reinforcing tape is preferably sewn to, for example, positions to which tension is applied. The sewn site is not particularly limited, and may be the backing cloth of the cloth, and the reinforcing tape may also be sewn to margins to seam in which two cloth panels are overlapped and sewn.

In the present invention described above, a structure in which the reinforcing tape is sewn with stitching to the margin to seam in the sewn site is preferable. Examples of the margin to seam may include an overlapped seam and a rolled seam. It is preferable that the reinforcing tape is back stitched with stitching to the cloth in each of both ends in the width direction of the plain weave structure of the reinforcing tape. The thread for sewing is not particularly limited, but is required to be lightweight and high in strength.

In the present invention as described above, there is a structure in which loop sections to be sewn to each of both ends in the longitudinal direction of the reinforcing tape are provided on the cloth. In order to apply tension to the cloth, loop sections are provided on the cloth. This loop section is constituted by a member having a tensile strength, such as a plastic, a synthetic fiber, a natural fiber, a synthetic leather, or a natural leather. Its shape may be ring-shaped or hook-shaped, and may be constituted by a ring tape, a string or a rope. When the loop sections and the both ends in the longitudinal direction of the reinforcing tape are directly sewn, even if tension is applied to the loop sections, the elongation of the cloth can be appropriately suppressed because the tensile strength is significantly improved by the reinforcing tape. The loop sections may also be constituted by the reinforcing tape. For example, the reinforcing tape is elongated outward from the end of the cloth, is rewound in a ring shape, and is sewn to the cloth.

When the reinforcing tape, or the cloth produced by sewing the reinforcing tape is sewn to sites, in which a tensile strength is required, of a zelt, a tarp or a tent, a lightweight zelt, tarp or tent having a sufficient tensile strength can be appropriately constituted.

Another aspect of the present invention is a web structure which is constituted using the reinforcing tape made of the weft threads which constitute the weave structure of the tape, and the warp threads which constitute the weave structure of the tape, wherein a part of the warp threads is made of the high-strength fiber. Further, another embodiment is a web structure which is constituted using the reinforcing tape in which a part of the warp threads and a part of the weft threads are made of the high-strength fiber. The high-strength fiber which makes a part of the weft threads is located in intersections of the web structure to form the intersections, and therefore sufficient tensile strength can be secured in the width (horizontal) direction and the longitudinal (vertical) direction of the reinforcing tape.

This web structure may be formed into a pouch, a sack, a bag, or the like. When the web structure is sewn to a backing cloth of a cloth, lightweight bags having a remarkably improved cloth strength can be constituted. Also, when the web structure is formed into a hammock shape, a lightweight, compact hammock can be formed. The web structure may be formed into a backpack, or may be sewn to sites in which a tensile strength is required.

MODE FOR CARRYING OUT THE INVENTION (Reinforcing Tape)

Figure 1:
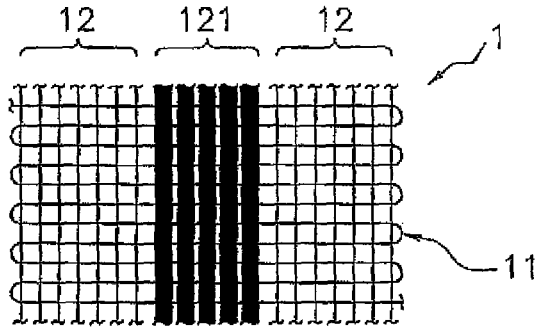
FIG. 1 is a view showing an example of a reinforcing tape.
Figure 1:
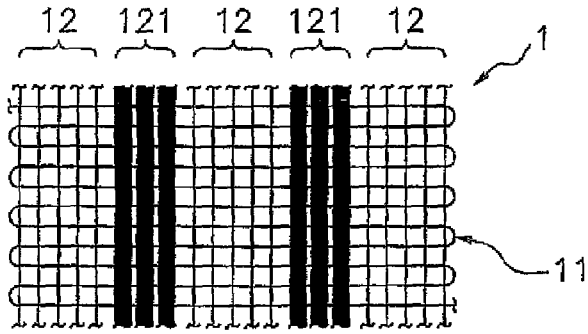
Figure 1:
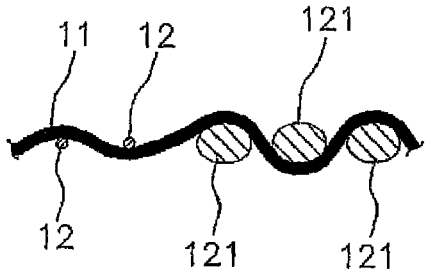

Next, the reinforcing tape of the present invention will be explained in detail. FIG. 1 is a view showing a structure example of a reinforcing tape 1. The reinforcing tape 1 has a plain weave structure. Weft threads 11 and warp threads 12 are made of a polyester monofilament. The polyester monofilament of the weft threads 11 and the warp threads 12 has a circular cross-sectional shape, and has a diameter of about 0.15 mm. The polyester monofilament has a loop strength, measured in accordance with JIS L 1013, of 3.0 cN/dtex, and a tensile strength, measured in accordance with JIS L 1013, of 1.5 cN/dtex or more. Warp threads 121 are made of a multifilament of an ultrahigh molecular weight polyethylene fiber, Dyneema (registered trademark) SK 60. In FIG. 1 (*a*), the five warp threads 121 are woven at the center in the width direction. FIG. 1 (*b*) shows another reinforcing tape structure example, in which the warp threads 121 are woven so as to be distributed in two bundle sections in the width direction. The plain weave structure has coarse lattices, and its aperture is within a range of about 0.3 to 1 mm. FIG. 1 (*c*) is a schematic view of a part (including high-strength fiber 121) of the plain weave structure, which is observed from the side in the width direction.

The reinforcing tape 1 shown in FIG. 1 (*a*) has a thickness of about 0.3 mm, a tape width of 10 mm and a weight per unit length of 1.16 g/m. The reinforcing tape 1 has an average tensile strength (breaking strength) of 537 N (n=3), measured using a 20 kN universal testing machine under test conditions of a tension rate of 100 mm/minute, a range of 1000 N, an initial tension of 0 N, and a gauge length of 100 mm. An average elongation percentage of the reinforcing tape 1 to the tensile strengths 100 N, 200 N and 300 N are, respectively, 4.3%, 7.3% and 10% (n=3). The test results are shown in Table 1.

TABLE 1

| | N: 1 | N: 2 | N: 3 | Average (N: 1-3) |
|---|---|---|---|---|
| 100 N | elongation percentage 5% | elongation percentage 4% | elongation percentage 4% | elongation percentage 4.3% |
| 200 N | elongation percentage 7% | elongation percentage 8% | elongation percentage 7% | elongation percentage 7.3% |
| 300 N | elongation percentage 10% | elongation percentage 11% | elongation percentage 9% | elongation percentage 10.0% |
| breaking strength | 566 N | 513 N | 532 N | 537 N |

Since the reinforcing tape 1 described above is lightweight and compact, and has a high tensile strength, the reinforcing tape 1 can be sewn to parts to which tension is applied and the sewn parts of the cloth to effectively reinforce the tensile strengths of those parts in the vertical direction. Also, because the reinforcing tape 1 has the plain weave structure made of the monofilaments, it has stretch stiffness; because the tape is easily sewn to the cloth, the puckering (shrinkage by sewing) does not occur, and the product quality (appearance and the like) is excellent; and because sewing working is easily performed, a high yield can be obtained, a sewing speed can be fast, and a production cost can be kept low.

(Another Structure Example of High-Strength Fiber)

Although, in the tape described above, the ultrahigh molecular weight polyethylene fiber, Dyneema (registered trademark) SK 60 is used as the high-strength fiber of the warp thread 121, Dyneema (registered trademark) SK 71 may be used, and an aramid fiber, a carbon fiber, a polyacrylate fiber or a PBO fiber having a tensile strength of 20 cN/dtex or more may also be used.

(Another Structure Example of Weave Structure)

Although, in the tape described above, the explanation of the plain weave structure is made as the weave structure, the weave structure is not particularly limited thereto, and it may be a diagonal weave structure or a herringbone weave structure.

Another Embodiment

Although, as the reinforcing tape described above, an example in which the high-strength fiber is used as a part of the warp threads is explained, the tape is not limited thereto, and a structure in which the high-strength fiber is woven into a part of the weft threads of the reinforcing tape may also be constituted.

(Zelt)

Figure 2:
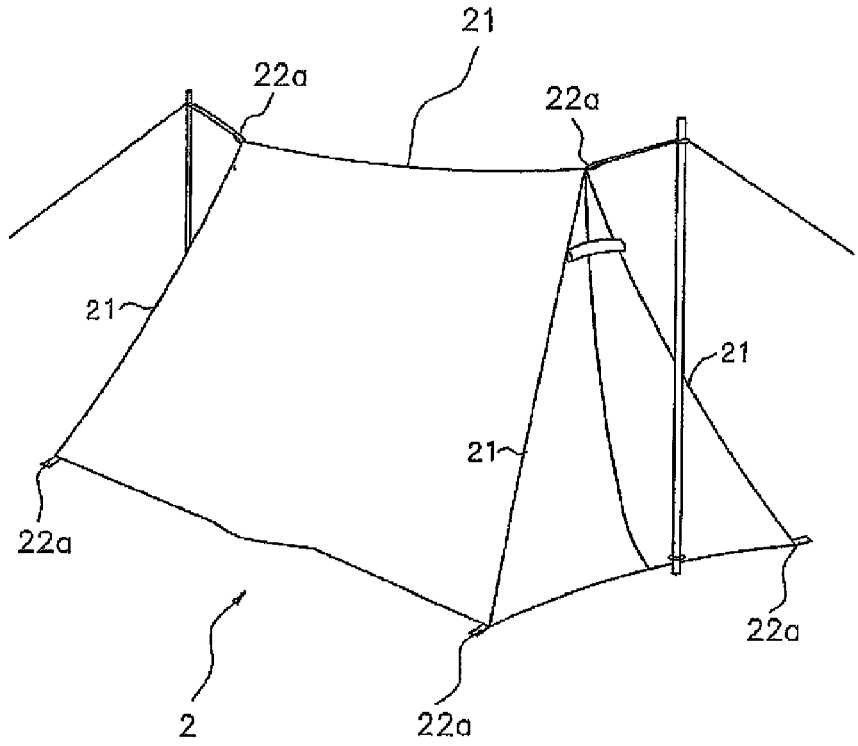
FIG. 2 is a view showing an example of a zelt to which a reinforcing tape is sewn.

An example in which the reinforcing tape 1 is sewn to a zelt will be explained using FIG. 2 below. A cloth for a zelt 2 is required to be lightness in weight and compactness because the zelt 2 is carried for emergency. The cloth for the zelt 2 is made of Nylon (registered trademark) 66, and a water-proof breathable coating is applied to the cloth. When the zelt 2 is set up, ridge lines 21 are formed by applying tension to loop sections 22*a* so that a roof and wall parts of the zelt 2 are formed. The reinforcing tape 1 is sewn to these ridge lines 21. The reinforcing tape 1 is also sewn to other sewn parts to which tension is applied, but is not shown in the figure.

Figure 3:
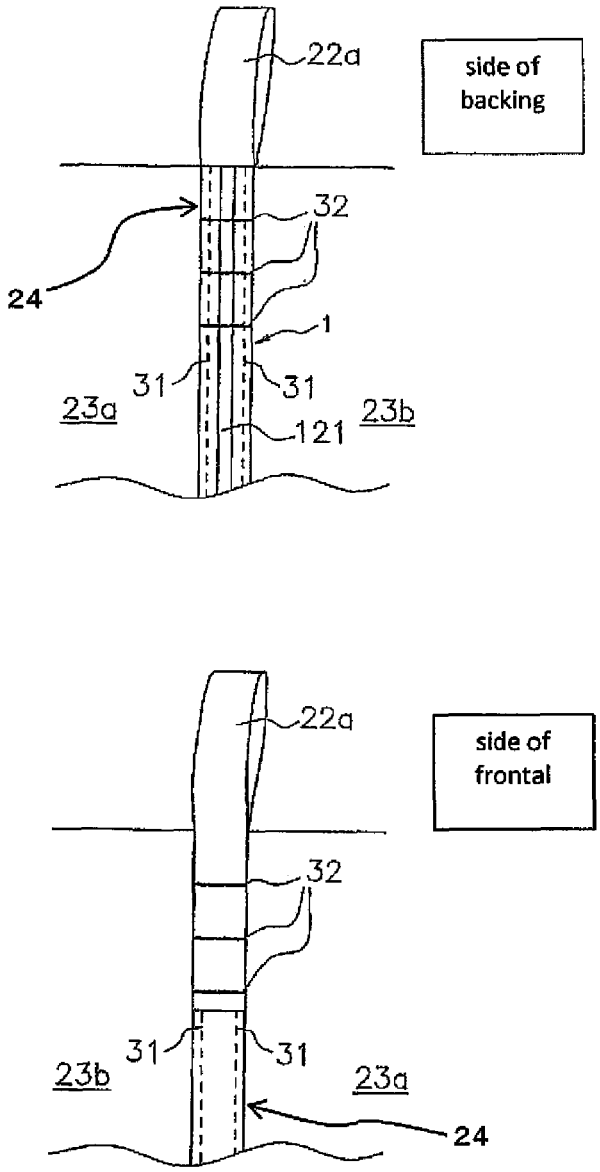
FIG. 3 is a view showing an example of a zelt to which a reinforcing tape is sewn.

A partial enlarged view of the ridge line 21 of the zelt 2 to which the reinforcing tape 1 is sewn is shown in FIG. 3. In the zelt 2 shown in FIG. 3, two cloths 23*a* and 23*b* are rolled and sewn in a margin to seam 24. Further, the reinforcing tape 1 is back stitched to this margin to seam 24 with stitches 31. A loop section 22*a* is back stitched 32 to the reinforcing tape 1 and the margin to seam 24. When the stitches are sewn, two stitch lines 31 can be sewn once because the reinforcing tape 1 itself has stretch stiffness, and therefore the workability is good. Also, because puckering (shrinkage by sewing) does not occur, the appearance quality is good, and because the stitching can be uniformly finished, the seam strength is stable in all sites.

Nylon 66, which is a material of the zelt 2, absorbs moisture and water in nature, and thus it swells and its strength is decreased, but when the ridge lines 21 to which tension is applied are reinforced by the reinforcing tapes 1, the zelt 2 can be set up without worrying about the decrease of the tensile strength of the cloth, and particularly it is suitable as a zelt 2 for emergency, which is used in a storm. In addition, because the tension in the vertical direction (ridge line direction) can be certainly and firmly functioned by the reinforcing tape 1, bending does not occur even if the whole zelt 2 swells, and cloth break due to wind can be remarkably decreased.

Examples and Comparative Examples

The tensile strength tests (breaking strength) of two kinds of samples, a zelt 2 having the reinforcing tape 1 and a zelt 2 having no reinforcing tape were performed. The sample having no reinforcing tape is formed by rolled seam of two cloths with stitching. The test environmental conditions were: (1) normal conditions (a sample which is humidified at a temperature of 20° C. under a humidity of 65% RH is tested), and (2) high humidity conditions (a sample is humidified at a temperature of 40° C. under a humidity of 90% over day and night, and then immediately the test is performed at 20° C. under a humidity of 65% RH).

Figure 4:
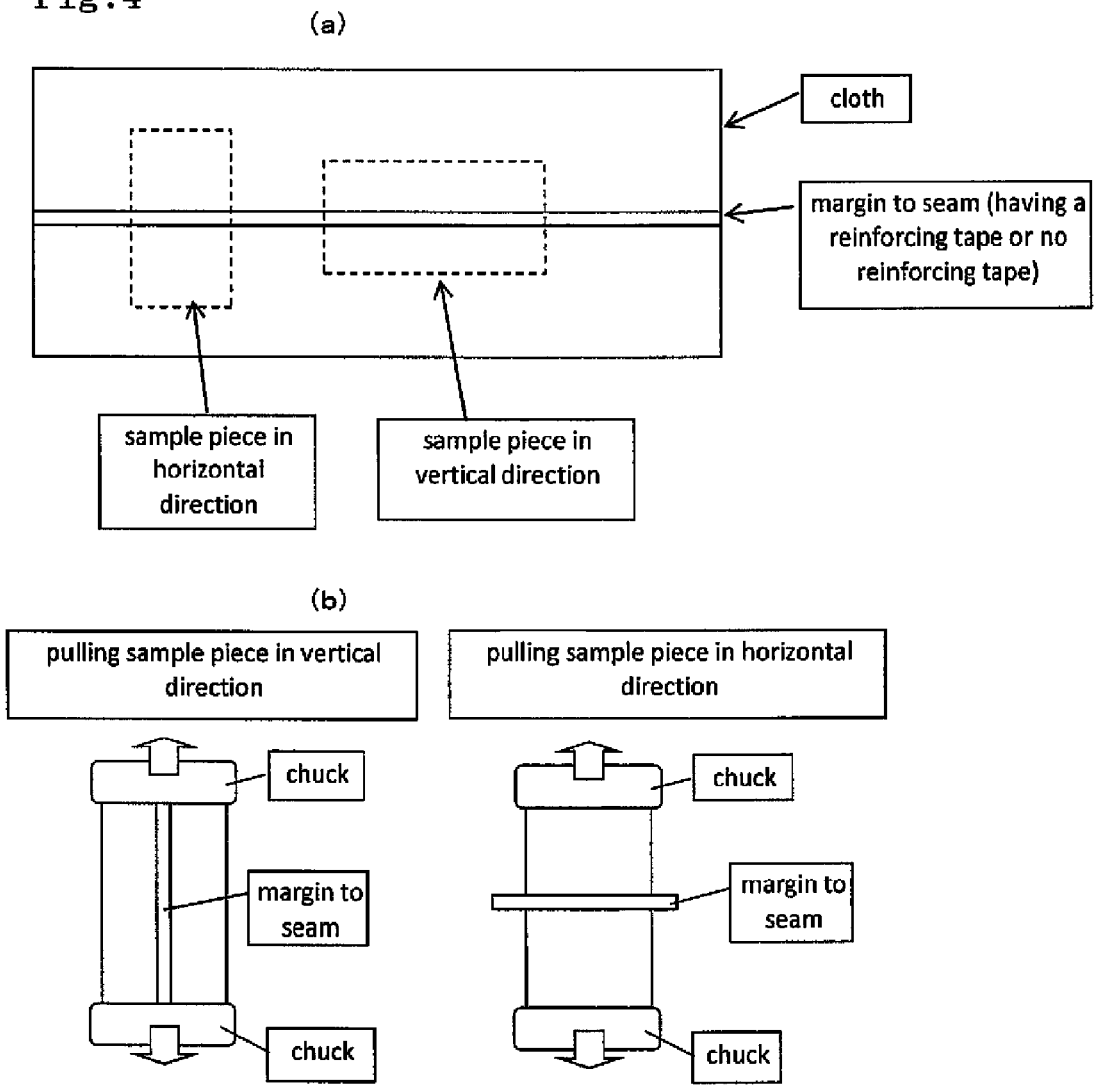
FIG. 4 is a view for explanation of a tensile test method.
Figure 5:
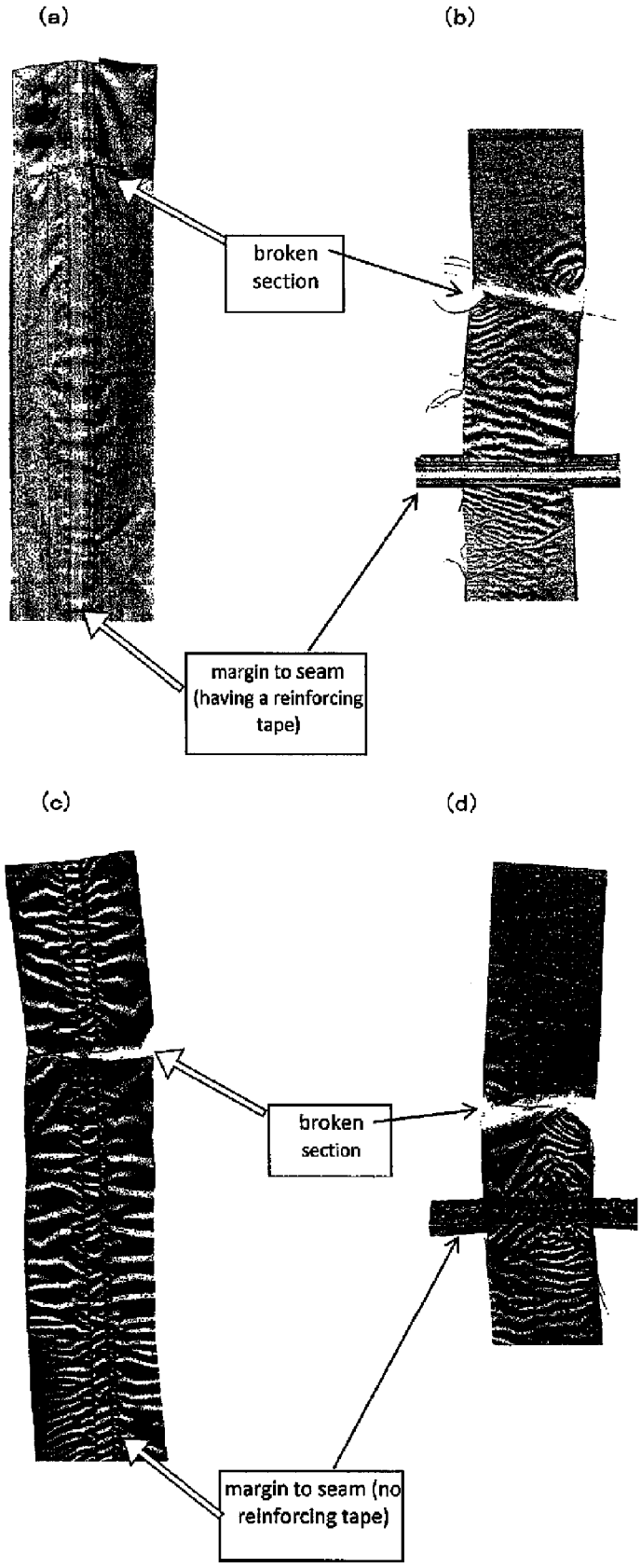
FIG. 5 is a view showing a front picture of a cloth broken in a tensile test.

FIG. 4 shows the tensile test method. FIG. 4 (*a*) shows a method for sampling a sample piece in the vertical direction and a sample piece in the horizontal direction. Each sample piece has a length in the longitudinal direction of 20 cm and a length in the width direction of 5 cm. As shown in FIG. 4 (*b*), a margin to seam (having a reinforcing tape or having no reinforcing tape) of the sample piece in the horizontal direction remains so that the margin sticks out from the edge in the width direction of the sample about 2 cm. As shown in FIG. 4 (*b*), the tensile strength test was performed using wave chucks under test conditions of a tension rate of 100 mm/minute and a length of the sample between grips of 150 mm. The results are shown in Table 2 and FIG. 5 (the results obtained in the normal conditions). FIGS. 5 (*a*) and (*b*) show states of breaking of the samples having the reinforcing tape, and FIGS. 5 (*c*) and (*d*) show states of breaking of the samples having no reinforcing tape. FIG. 5 (*a*), which shows the sample piece in the vertical direction (having the reinforcing tape), shows a state in which the cloth is broken because the warp threads (Dyneema (registered trademark)) in the reinforcing tape are misaligned in the chucked part. FIG. 5 (*b*), which shows the sample piece in the horizontal direction (having the reinforcing tape), shows a state in which the cloth is broken at the chucked part. FIG. 5 (*c*), which shows the sample piece in the vertical direction (having no reinforcing tape), shows a state in which the cloth is broken. FIG. 5 (*d*), which shows the sample piece in the horizontal direction (having no reinforcing tape), shows a state in which the cloth is broken at the chucked part.

TABLE 2

| | | reinforcement by reinforcing tape (N) | no reinforcement (N) | reinforcement ÷ no reinforcement × 100 (%) |
|---|---|---|---|---|
| normal conditions | vertical direction | 688.5 N | 249.8 N | 275.6% |
| | horizontal direction | 239.2 N | 214.6 N | 111.5% |
| high humidity conditions | vertical direction | 672.2 N | 198.7 N | 338.3% |
| | horizontal direction | 210.3 N | 200.4 N | 104.9% |

In the results in Table 2, the tensile strengths (N) are expressed as the breaking strength of the cloth. When there was reinforcement by the reinforcing tape 1, the result in which the cloth itself had been broken prior to breaking of the reinforcing tape 1 was obtained, which meant the result in which the cloth strength could be significantly reinforced by the reinforcing tape. Comparing the sample "having the reinforcement" with the sample "having no reinforcement" under the normal conditions, it was confirmed that the sample "having the reinforcement" was not less than 2.5 times stronger than the sample having no reinforcement in the vertical direction. Also, because the cloth was broken in the sample in the horizontal direction before the tensile load was applied to the reinforcing tape 1, it seemed that there was little predominance of the sample "having the reinforcement" over the sample "having no reinforcement".

Comparing the case of the high humidity conditions with the case of the normal conditions, the sample "having no reinforcement" showed not less than 20% decrease in strength in the vertical direction, whereas the sample "having the reinforcement" showed not more than 3% decrease in strength in the vertical direction. It is considered that the cloth of the zelt 2 absorbed moisture and water to swell, which leaded to decrease in strength. That is, it was confirmed that the predominance in the strength of the sample "having the reinforcement" was further greater than the sample "having no reinforcement" in the high humidity conditions. The zelt "having the reinforcement", therefore, is not likely to be broken even under strong wind of bad weather, compared to the zelt "having no reinforcement".

The results in Examples and Comparative Examples demonstrated the followings. The zelt having the reinforcement has clearly predominance in the strength in the vertical direction, and because the zelt can be firmly strained in the vertical direction when it is set up under a storm, the whole zelt is not bent even if it swells, and the breaking of the cloth due to wind can be remarkably decreased. The predominance in the strength is not really confirmed in the horizontal direction for a thin cloth currently used. It can assumed, however, that for a heavy, strong cloth such as one for a tent, there occurs a difference in the breaking strength between the tent "having the reinforcement" and the tent "having no reinforcement", if the cloth is kept until a strength in which a load reaches to a tape. The strength in the vertical direction, therefore, is important, and the strength in the horizontal direction is not necessary to be as high as the strength in the vertical direction, because the force in the horizontal direction is applied to the whole cloth. That is, the properties of the reinforcing tape 1 in this embodiment can be sufficiently exhibited, and the tape can be suitably applied to zelts, tents, and the like.

(Another Structure Example of Zelt)

In the zelt 2 described above, Nylon (registered trademark) 66 was used as a cloth, but the zelt can be made of another cloth of a fiber such as polyester fiber. In addition, the reinforcing tape 1 can be sewn to a cloth other than the zelt to significantly improve the tensile strength of the cloth.

In the zelt described above, the two cloths were sewn with each other on the ridge line 21, but the zelt may be made by using one cloth. The reinforcing tape 1 may be sewn to all of other parts of the zelt 2 to which tension is applied, or some parts selected therefrom.

In the embodiment described above, the structure example in which the reinforcing tape is sewn to the zelt cloth has been explained, but the present invention is not particularly limited thereto, and the reinforcing tape can be sewn to any site which requires tensile strength of any cloth, such as a tent or a tarp.

(Web Structure)

Figure 6:
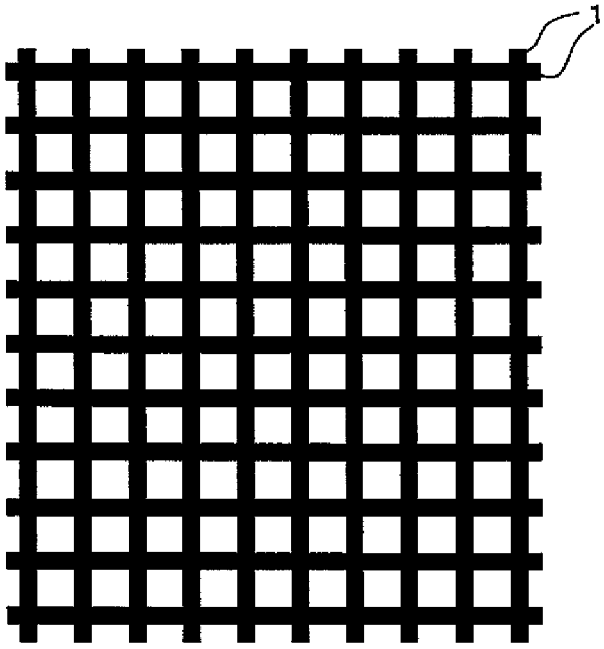
FIG. 6 is a view showing an example of a web structure.

FIG. 6 shows one example of a web structure constituted by the above-mentioned reinforcing tapes 1. The web structure shown in FIG. 6 is a structure in which the reinforce tapes are orthogonally placed in the vertical direction and in the horizontal direction. The tapes may be sewn or bonded with strings at intersection points, or the web structure may have a plain weave structure. The openings in the web structure are not particularly limited, and the size thereof can be determined depending on the use thereof. The appearance of the web structure is not limited to that shown in FIG. 6, and the openings of the web structure may be in the shape of a diamond shape of a parallelogram, a polygon shape, or a cobweb. The size of the openings may not be uniform. This web structure can be applied to a hammock. The web structure has a high tensile strength in the longitudinal direction, and is lightweight and compact, it is thus suitable for a hammock for emergency. The web structure can be formed into a bag, which can be applied to a handbag or an accessory pouch. This web structure can be formed into a backpack, or can be sewn to a part of a backpack.

EXPLANATION OF NUMERALS

1: reinforcing tape
2: zelt
11: weft thread
12: warp thread
121: high-strength fiber
21: ridge line
22*a*: loop section
24: margin to seam
31: stitch

The invention claimed is:

1. A zelt comprising a cloth formed into said zelt,
wherein the cloth produced by sewing a reinforcing tape to a woven material,
wherein the woven material is made of a polyester fiber, a nylon fiber, a rayon fiber or composite textured fiber of any of the foregoing,
wherein the reinforcing tape is sewn to positions to which tension is applied,
wherein the reinforcing tape for reinforcing a tensile strength of a cloth comprising:
weft threads which constitute a weave structure of the reinforcing tape, and
warp threads which constitute a weave structure of the reinforcing tape,
wherein only some of the warp threads are made of a high-strength fiber, and
wherein the high-strength fiber which constitutes said some of the warp threads are made of a single fiber or a combination of multiple fibers consisting of an ultrahigh molecular weight polyethylene fiber,
wherein the ultrahigh molecular weight polyethylene fiber has a tensile strength of 20 cN/dtex or more.

2. The zelt according to claim 1, wherein the weave structure is constituted by a coarse, plain weave structure, and the warp threads made of a high-strength fiber are placed at a center section in the width direction of the reinforcing tape.

3. The zelt according to claim 1, wherein only some of the weft threads which constitute the weave structure of the reinforcing tape are made of a high-strength fiber, and
wherein the high-strength fiber which constitutes said some of the weft threads are made of a single fiber or a combination of multiple fibers selected from the group consisting of polyethylene fibers, aramid fibers, carbon fibers, polyacrylate fibers, and PBO fibers.

4. The zelt according to claim 1, wherein the weft threads and the warp threads which constitute the weave structure of the reinforcing tape are monofilaments made of any one fiber material selected from the group consisting of rayon fibers, polyamide fibers, polyester fibers, and acrylic fibers.

5. The zelt according to claim 1, wherein the reinforcing tape is back stitched with stitching to a margin to seam in a sewn site of the woven material.

6. The zelt according to claim 1, which has a loop section which is sewn to each of both ends in the longitudinal direction of the reinforcing tape.

7. The zelt according to claim 1, wherein the ultrahigh molecular weight polyethylene fiber has a density of 0.99 g/cm$^3$ or less.

8. The zelt according to claim 1, wherein the ultrahigh molecular weight polyethylene fiber has a modulus of elasticity of 750 cN/dtex or more.

9. The zelt according to claim 1, wherein a specific gravity of the ultrahigh molecular weight polyethylene fiber is 0.99 or less.

10. A tarp comprising a cloth according to claim 6, formed into the tarp wherein the cloth produced by sewing a reinforcing tape to a woven material, wherein the woven material is made of a polyester fiber, a nylon fiber, a rayon fiber or composite textured fiber of any of the foregoing, wherein the reinforcing tape is sewn to positions to which tension is applied, wherein the reinforcing tape for reinforcing a tensile strength of a cloth comprising:

weft threads which constitute a weave structure of the reinforcing tape, and warp threads which constitute a weave structure of the reinforcing tape, wherein only some of the warp threads are made of a high-strength fiber, and wherein the high-strength fiber which constitutes said some of the warp threads are made of a single fiber or a combination of multiple fibers consisting of an ultrahigh molecular weight polyethylene fiber, wherein the ultrahigh molecular weight polyethylene fiber has a tensile strength of 20 cN/dtex or more.

11. The tarp according to claim 10, wherein the reinforcing tape is back stitched with stitching to a margin to seam in a sewn site of the woven material.

12. The tarp according to claim 10, which has a loop section which is sewn to each of both ends in the longitudinal direction of the reinforcing tape.

13. The tarp according to claim 10, wherein the weave structure is constituted by a coarse, plain weave structure, and the warp threads made of a high-strength fiber are placed at a center section in the width direction of the reinforcing tape.

14. The tarp according to claim 10, wherein only some of the weft threads which constitute the weave structure of the reinforcing tape are made of a high-strength fiber, and wherein the high-strength fiber which constitutes said some of the weft threads are made of a single fiber or a combination of multiple fibers selected from the group consisting of polyethylene fibers, aramid fibers, carbon fibers, polyacrylate fibers, and PBO fibers.

15. The tarp according to claim 10, wherein the weft threads and the warp threads which constitute the weave structure of the reinforcing tape are monofilaments made of any one fiber material selected from the group consisting of rayon fibers, polyamide fibers, polyester fibers, and acrylic fibers.

16. The tarp according to claim 10, wherein the ultrahigh molecular weight polyethylene fiber has a density of 0.99 g/cm$^3$ or less.

17. The tarp according to claim 10, wherein the ultrahigh molecular weight polyethylene fiber has a modulus of elasticity of 750 cN/dtex or more.

18. The tarp according to claim 10, wherein a specific gravity of the ultrahigh molecular weight polyethylene fiber is 0.99 or less.

19. A tent comprising a cloth formed into the tent wherein the cloth produced by sewing a reinforcing tape to a woven material, wherein the woven material is made of a polyester fiber, a nylon fiber, a rayon fiber or composite textured fiber of any of the foregoing, wherein the reinforcing tape is sewn to positions to which tension is applied, wherein the reinforcing tape for reinforcing a tensile strength of a cloth comprising:

weft threads which constitute a weave structure of the reinforcing tape, and warp threads which constitute a weave structure of the reinforcing tape, wherein only some of the warp threads are made of a high-strength fiber, and wherein the high-strength fiber which constitutes said some of the warp threads are made of a single fiber or a combination of multiple fibers consisting of an ultrahigh molecular weight polyethylene fiber, wherein the ultrahigh molecular weight polyethylene fiber has a tensile strength of 20 cN/dtex or more.

20. The tent according to claim 19, wherein the reinforcing tape is back stitched with stitching to a margin to seam in a sewn site of the woven material.

21. The tent according to claim 19, which has a loop section which is sewn to each of both ends in the longitudinal direction of the reinforcing tape.

22. The tent according to claim 19, wherein the weave structure is constituted by a coarse, plain weave structure, and the warp threads made of a high-strength fiber are placed at a center section in the width direction of the reinforcing tape.

23. The tent according to claim 19, wherein only some of the weft threads which constitute the weave structure of the reinforcing tape are made of a high-strength fiber, and wherein the high-strength fiber which constitutes said some of the weft threads are made of a single fiber or a combination of multiple fibers selected from the group consisting of polyethylene fibers, aramid fibers, carbon fibers, polyacrylate fibers, and PBO fibers.

24. The tent according to claim 19, wherein the weft threads and the warp threads which constitute the weave structure of the reinforcing tape are monofilaments made of any one fiber material selected from the group consisting of rayon fibers, polyamide fibers, polyester fibers, and acrylic fibers.

25. The tent according to claim 19, wherein the ultrahigh molecular weight polyethylene fiber has a density of 0.99 g/cm$^3$ or less.

26. The tent according to claim 19, wherein the ultrahigh molecular weight polyethylene fiber has a modulus of elasticity of 750 cN/dtex or more.

27. The tent according to claim 19, wherein a specific gravity of the ultrahigh molecular weight polyethylene fiber is 0.99 or less.

* * * * *